United States Patent [19]

Takashima et al.

[11] Patent Number: 4,808,566

[45] Date of Patent: Feb. 28, 1989

[54] RECORDING MATERIAL

[75] Inventors: Masanobu Takashima; Ken Iwakura; Masato Satomura; Katsumi Matsuoka, all of Shizuoka, Japan

[73] Assignee: Fuji Photo Film Co., Ltd., Kanagawa, Japan

[21] Appl. No.: 92,846

[22] Filed: Sep. 3, 1987

[30] Foreign Application Priority Data

Sep. 3, 1986 [JP] Japan ..... 61-207547
Jul. 11, 1987 [JP] Japan ..... 62-164686
Jul. 29, 1987 [JP] Japan ..... 62-189496

[51] Int. Cl.[4] ..... B41M 5/16; B41M 5/18; B41M 5/22

[52] U.S. Cl. ..... 503/217; 427/151; 428/913; 428/914; 503/220; 503/223

[58] Field of Search ..... 427/150–152; 503/220, 223, 217, 225, 216, 218, 210–212; 549/307; 428/913, 914

[56] References Cited

U.S. PATENT DOCUMENTS 4,026,883 5/1977 Farber ..... 503/223

FOREIGN PATENT DOCUMENTS 0027884 2/1984 Japan ..... 549/307

*Primary Examiner*—Bruce H. Hess
*Attorney, Agent, or Firm*—Sughrue, Mion, Zinn, Macpeak, and Seas

[57] ABSTRACT

A recording material comprising an electron-donating colorless dye and an electron-accepting compound, wherein said colorless dye is a dimer of a 3-(4-substituted aminoaryl)-3-(substituted indol-3-yl)phthalide compound. The recording material provides an image exhibiting satisfactory fastness, and particularly fastness to light even when preserved in a transparent polyvinyl chloride film.

19 Claims, No Drawings

RECORDING MATERIAL

FIELD OF THE INVENTION

The present invention relates to a recording material, and more particularly, to a recording material utilizing an electron-donating colorless dye and an electron-accepting compound, which has improved color developability and shelf-life, and provides a color image of heightened stability.

BACKGROUND OF THE INVENTION

Recording materials utilizing a combination of an electron-donating colorless dye and an electron-accepting compound have already been well-known as pressure sensitive paper, heat sensitive paper, light- and pressure-sensitive paper, electro thermo-recording paper and so on.

Detailed descriptions of these papers are given, for instance, in British Pat. No. 2,140,449, U.S. Pat. Nos. 4,480,092 and 4,436,920, Japanese Patent Publication No. 23922/85, Japanese Patent Application (OPI) Nos. 179836/82, 123556/85 and 123557/85 (the term "OPI" as used herein means an "published unexamined Japanese patent application"), and so on.

The recording materials must have properties of (1) producing a sufficiently high color density of the developed image at a sufficiently high speed, (2) forming no fog, (3) producing a developed image which retains sufficient fastness after color development, (4) producing a developed image of an appropriate hue, and showing an aptitude for copying machines, (5) having a high signal to noise (S/N) ratio, (6) producing a developed color image having a sufficiently high chemical resistance, (7) being produced from dyes which are readily able to be dissolved in an organic solvent, and so on. However, recording materials which satisfy all of these requirements to perfection have not been obtained yet.

In particular, studies on improvements in characteristics of such recording materials have been actively pursued in response to the speeding-up of the recording system and the diversification of requirements in recent years.

As for the compounds capable of developing a blue to bluish violet color, diphenylmethane type compounds, triphenylmethane type compounds, phthalide compounds, Lueco-methylene Blue type compounds and the like have so far been known. However, these compounds possess their individual defects.

For instance, the indolylphthalide compounds as described in U.S. Pat. Nos. 3,829,322 and 4,062,866 develop a color image having a satisfactory hue and satisfactory light fastness at a high rate of development, but the image produced is insufficient in stability. In particular, when preserved in cases or files made of transparent polyvinyl chloride commonly employed for storage of records, the image is seriously inferior in light-fastness and also undergoes smearing due to plasticizers.

Our attention has been directed to various characteristics of electron-donating colorless dyes and electron-accepting compounds, including solubilities in oil, solubilities in water, partition coefficients, pKa values, polarities of substituent groups, positions of substituent groups, changes in crystallinity and solubility upon use in a warmed condition and so on, and with which the development of excellent substances for recording materials and recording materials has been sought.

SUMMARY OF THE INVENTION

Accordingly, one object of this invention is to provide a recording material which produces a dye image having satisfactory stability and chemical resistance as well as satisfying all other requirements.

It has now been found that the above object of the present invention can be accomplished by a recording material comprising an electron-donating colorless dye and an electron-accepting compound, wherein the colorless dye is a dimer of a 3-(4-substituted aminoaryl)-3-(substituted indol-3-yl) phthalide compound.

DETAILED DESCRIPTION OF THE INVENTION

The colorless dye of the present invention preferably includes dimers in which 3-(4-substituted aminoaryl)-3-(substituted indol-3-yl)-phthalide moieties are connected via an alkylene group or alkenylene group having from 1 to 20 carbon atoms. Of these, more preferred are those represented by following formulae (I) to (IV):

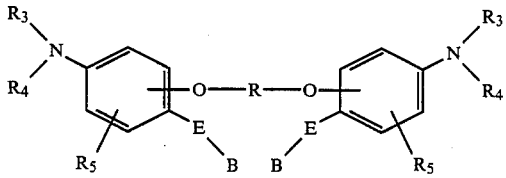

(I)

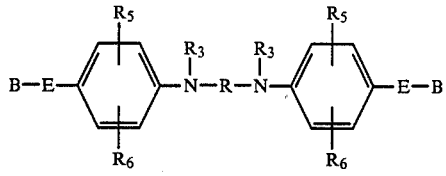

(II)

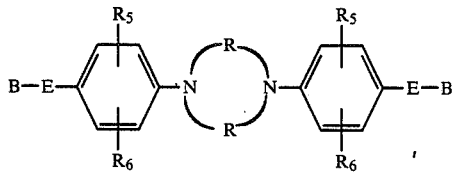

(III)

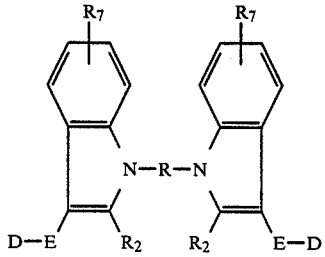

(IV)

wherein

B represents

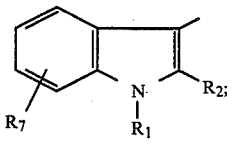

D represents

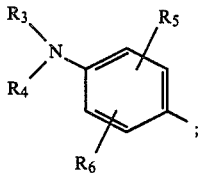

E represents

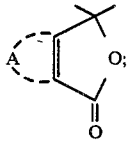

$R_1$, $R_2$, $R_3$, and $R_4$, which may be the same or different, each represents a hydrogen atom, an alkyl group, an aryl group or an acyl group, or $R_3$ and $R_4$ are taken together to form a 5- to 8-membered ring; $R_5$, $R_6$, and $R_7$, which may be the same or different, each represents a hydrogen atom, an alkyl group, an aryl group, a halogen atom, an alkoxy group or a substituted amino group; A represents atoms necessary for forming a substituted or unsubstituted aromatic ring (which includes a hetero ring); and R represents a substituted or unsubstituted alkylene or alkenylene group having from 1 to 20 carbon atoms which may contain therein an oxygen atom or a nitrogen atom.

The aryl group and aromatic ring as used herein includes a phenyl group, a naphthyl group and an aromatic heterocyclic group such as a pyridine ring, an indole ring, a quinoline ring, a pyrrole ring, a benzothiophene ring, a pyradine ring, or a carbazole ring. These groups each may further have a substituent group, such as an alkyl group, an acyl group, an alkoxy group, an aryl group, an aryloxy group, a halogen atom, a nitro group, a cyano group, a substituted carbamoyl group (e.g., a methyl carbamoyl group, an ethyl carbamoyl group, a butyl carbamoyl group, etc.), a substituted sulfamoyl group, a substituted amino group, a substituted oxycarbonyl group, a substituted oxysulfonyl group (e.g., a methyloxysulfonyl group, an ethyloxysulfonyl group, etc.) or the like. The substituted or unsubstituted aryl group preferably has 6 to 20 carbon atoms.

The alkyl group as used herein includes a saturated alkyl group, an unsaturated alkyl group, such as an alkenyl group or an alkinyl group, and an alicyclic group having 5 to 8 carbon atoms. These groups each may further have a substituent group, such as a substituted or unsubstituted aryl group, a substituted or unsubstituted alkoxy group, a substituted or unsubstituted aryloxy group, a substituted or unsubstituted acyl group, a halogen atom, a cyano group, a furfuryl group, or the like. The substituted or unsubstituted alkyl group preferably has 1 to 20 carbon atoms.

The alkoxy group as used herein may have a substituent, such as those enumerated above.

The acyl group as used herein may have a substituent, such as those as exemplified for the alkyl group.

The substituted amino group as used herein includes a monoalkylamino group, a dialkylamino group, and a monoacylamino group.

In formulae (I) to (IV), $R_1$, $R_2$, $R_3$, and $R_4$ each preferably represents a hydrogen atom, an alkyl group having from 1 to 18 carbon atoms, an acyl group, an alkyl group having from 1 to 18 carbon atoms substituted with a halogen atom, an alkoxy group, an aryl group, an aryloxy group, an acyl group, a cyano group or a furfuryl group, an aryl group having from 6 to 12 carbon atoms or an aryl group having from 6 to 12 carbon atoms substituted with a halogen atom, an alkoxy group, an aryl group, an aryloxy group, an alkyl group or an acyl group.

More preferably, $R_1$, $R_3$, and $R_4$ each represents a hydrogen atom, a substituted or unsubstituted alkyl group having from 2 to 12 carbon atoms or a substituted or unsubstituted aryl group having from 6 to 10 carbon atoms. It is preferable that either one of $R_3$ and $R_4$ is an alkyl group.

The 5- to 8-membered ring formed by $R_3$ and $R_4$ includes piperidine, morpholine, pyrrolidine, piperazine, hexamethyleneimine, caprolactam, indole, and the like.

The amino groups inclusive of cyclic amino groups as represented by

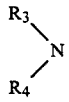

include a pyrrolidino group, a piperazino group, a morpholino group, an N-phenylpiperidino group, an N-ethylpiperidino group, a diethylamino group, a dipropylamino group, a dibutylamino group, an N-ethyl-N-isobutylamino group, an N-ethyl-N-isoamylamino group, an N-ethyl-N-cyclohexylamino group, a diamylamino group, a dihexylamino group, a dioctylamino group, an N-ethyl-N-tetrahydrofurfurylamino group, and the like.

$R_2$ preferably represents a hydrogen atom, an alkyl group having from 1 to 12 carbon atoms or an aryl group having from 6 to 10 carbon atoms, and more preferably a methyl group, an ethyl group, a phenyl group or a hydrogen atom.

$R_5$, $R_6$, and $R_7$ each preferably represents a hydrogen atom, an alkyl group having from 1 to 18 carbon atoms, an alkoxy group having from 1 to 18 carbon atoms, a chlorine atom, a bromine atom, a mono- or dialkylamino group having from 1 to 12 carbon atoms or a monoacylamino group having from 1 to 16 carbon atoms.

More preferably, $R_5$, $R_6$, and $R_7$ each represents a hydrogen atom, a methyl group, an ethyl group, a phenyl group, a dimethylamino group, a diethylamino group, an acetylamino group, a methoxy group, an ethoxy group, an n-octyloxy group, a benzyloxy group, a $\beta$-phenoxyethoxy group, a $\beta$-(4-methoxyphenoxy) ethoxy group, a chlorine atom, a bromine atom, etc.

In particular, $R_5$ preferably represents a hydrogen atom, a substituted amino group or an alkyl group.

In particular, $R_6$ preferably represents a substituted amino group or an alkoxy group from the standpoint of a developed hue.

$R_5$ and $R_6$ each is preferably bonded to the aromatic ring at the m-position with respect to

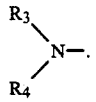

In formulae (I) to (IV), A preferably represents

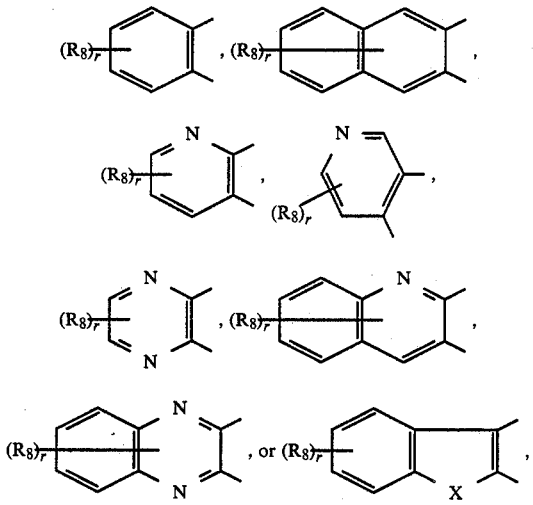

wherein $R_8$ has the same meaning as $R_7$, X represents an oxygen atom, a sulfur atom or $—NR_9—$; r represents an integer of from 1 to 6; and $R_9$ has the same meaning as $R_3$.

More preferably, A represents

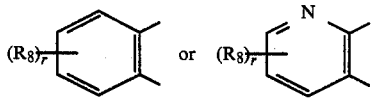

from the standpoint of cost and a developed hue.

The alkylene or alkenylene group represented by R may contain therein a linking group, e.g., —O—, —S—, —CO—, $—OCO_2—$, $—CO_2—$, $SO_2—$, $—NR_9—$, —NHCO—, —NHCONH—, $—NHCO_2—$, —CO-CO—,

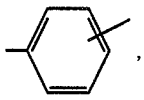

etc., wherein $R_9$ has the same meaning as $R_3$. The alkylene or alkenylene group represented by R may have a substituent, e.g., an alkoxy group, a halogen atom, an aryl group, a cyano group, a nitro group, a hydroxyl group, etc. R preferably represents $—C_nH_{2m}—$, $—C_nH_{2m}—(Y—C_nH_{2m})_p—$, $—C_nH_{2m}—Y—C_qH_{2t}—Z—C_nH_{2m}—$, $—COC_nH_{2m}CO—$ or $—CONHC_nH_{2m}CONH—$, wherein p represents an integer of from 1 to 3; n, m, q and t each represents an integer of from 1 to 20, provided that m and t are not greater than n and q, respectively; and Y and Z each represents —O—, —S—, —CO—, $—OCO_2—$, $—CO_2—$, $—SO_2—$, $—NR_9—$, —NHCO—, —NHCONH—, $—NHCO_2—$, —CO-CO— or

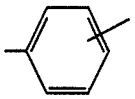

More preferably, R represents $—C_nH_{2n}—$, $—C_nH_{2n-2}—$, $—C_nH_{2n}OCH_2OC_nH_{2n}—$,

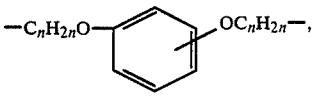

$—C_nH_{2n}SC_nH_{2n}—$,

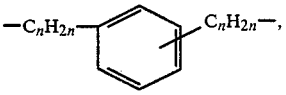

$—C_nH_{2n}OC_nH_{2n}OC_nH_{2n}—$, $—CH_2CO_2C_nH_{2n}OCOCH_2—$, $—C_nH_{2n}OC_nH_{2n}—$, $—C_nH_{2n}OCOC_nH_{2n}CO_2C_nH_{2n}—$,

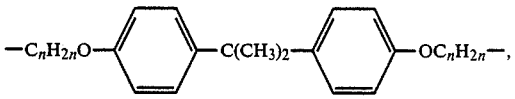

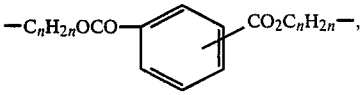

$—C_nH_{2n}OCONHC_qH_{2q}NHCO_2C_nH_{2n}—$, $—C_nH_{2n}NHCONHC_qH_{2q}NHCONHC_nH_{2n}—$,

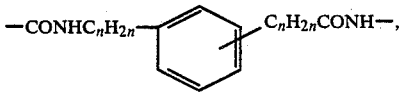

$—COC_{n2n}—CO—$, etc. Of these, the most preferred are $—C_nH_{2n}—$,

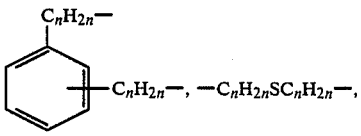

$—C_nH_{2n}OC_nH_{2n}—$, and $—C_nH_{2n}OC_nH_{2n}OC_nH_{2n}—$.

$—C_nH_{2n}SC_nH_{2n}—$, $—C_nH_{2n}OC_nH_{2n}—$, and $—C_nH_{2n}OC_nH_{2n}OC_nH_{2n}—$.

In formula (I), —O—R—O— is preferably bonded to each of the rings at the m-position with respect to

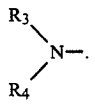

Of the electron-donating colorless dyes represented by formulae (I) to (IV), those of formula (I) or (IV) in which A is

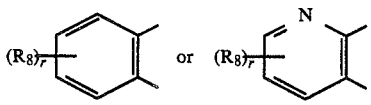

are particularly preferred from the standpoint of handling, cost, and hue of a developed color. Further, those compounds whose solubility in diisopropylnaphthalene, KMC-113 (made by Kureha Kagaku Kogyo Kabushiki Kaisha) at 25° C. is 3% or more, particularly 5% or more are preferred in solubility to an organic solvent, such as aromatic solvents or paraffins.

The electron-donating colorless dyes, hereinafter referred to as color formers or colorless dyes, of the present invention are colorless or light colored crystals highly soluble in an organic solvent, and have an advantage in that contact with electron-accepting substances results in a rapid blue-coloration. The developed dyes are particularly advantageous from the standpoint of the long-range storage of records since they are highly stable, compared with dyes produced from conventional color formers, and hardly cause discoloration and/or fading even when exposed to light, heat and/or moisture for a long time. In addition, the color formers are excellent in stability, that is, they suffer no change in quality and no coloration even after long storage, and retain sufficiently high color formability. Therefore, the electron-donating colorless dyes of the present invention possess nearly ideal properties as a color former for pressure sensitive paper, heat sensitive paper and the like.

As typical examples of the elctron-donating colorless dyes, which can be employed in the present invention, mention may be made of the following compounds, although the present invention is not to be construed as being limited thereto.

Compound of formula (I) (wherein —O—R—O— is at the m-position with respect to $\begin{matrix} R_3 \\ \diagdown \\ N- \\ \diagup \\ R_4 \end{matrix}$)

| Compound No. | $R_1$ | $R_2$ | $R_3$ | $R_4$ | $R_5$ | $R_7$ | A | R | Hue on Silica Gel |
|---|---|---|---|---|---|---|---|---|---|
| 1 | $C_2H_5$ | $CH_3$ | $C_2H_5$ | $C_2H_5$ | H | H | 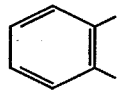 | $(CH_2)_4$ | bluish purple |
| 2 | $C_2H_5$ | $CH_3$ | $C_2H_5$ | $C_2H_5$ | H | H | 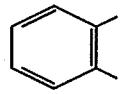 | $(CH_2)_2O(CH_2)_2$ | bluish purple |
| 3 | $C_2H_5$ | $CH_3$ | $C_2H_5$ | $C_2H_5$ | H | H | 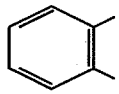 | $(CH_2)_{10}$ | bluish purple |
| 4 | $C_2H_5$ | $CH_3$ | $C_2H_5$ | $C_2H_5$ | H | H | 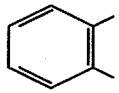 | $(C_2H_4O)_2C_2H_4$— | bluish purple |
| 5 | $nC_8H_{17}$ | $CH_3$ | $C_2H_5$ | $C_2H_5$ | H | H | 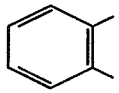 | $(CH_2)_4$ | bluish purple |
| 6 | 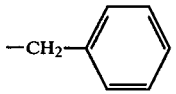 | $CH_3$ | $C_2H_5$ | $C_2H_5$ | H | H | 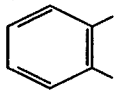 | $(CH_2)_2O(CH_2)_2$ | bluish purple |
| 7 | $C_2H_5$ | $CH_3$ | n-$C_4H_9$ | n-$C_4H_9$ | H | H | 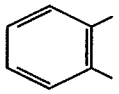 | $(CH_2)_4$ | bluish purple |

-continued

Compound of formula (I) (wherein —O—R—O— is at the m-position with respect to $R_3$, $R_4$ N—)

| Compound No. | $R_1$ | $R_2$ | $R_3$ | $R_4$ | $R_5$ | $R_7$ | A | R | Hue on Silica Gel |
|---|---|---|---|---|---|---|---|---|---|
| 8 | $C_2H_5$ | $CH_3$ | 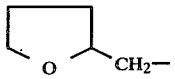 | $C_2H_5$ | H | H | 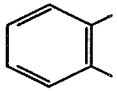 | $-C_2H_4OCO(CH_2)_4CO_2C_2H_4-$ | bluish purple |
| 9 | $nC_8H_{17}$ | $CH_3$ | $C_2H_5$ | $C_2H_5$ | H | H | 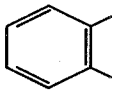 | 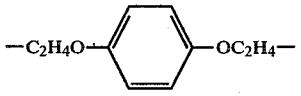 | bluish purple |
| 10 | n-$C_8H_{17}$ | $CH_3$ | $C_2H_5$ | $C_2H_5$ | H | H | 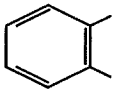 | $-C_2H_4\overset{H}{N}CO\overset{H}{N}(CH_2)_6\overset{H}{N}CO\overset{H}{N}C_2H_4-$ | bluish purple |
| 11 | n-$C_8H_{17}$ | $CH_3$ | $C_2H_5$ | $C_2H_5$ | H | H | 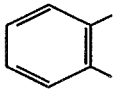 | 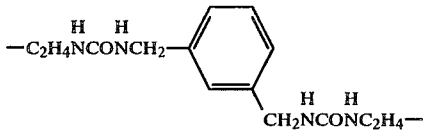 | bluish purple |
| 12 | n-$C_8H_{17}$ | $CH_3$ | $C_2H_5$ | $C_2H_5$ | H | H | 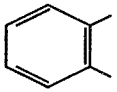 | 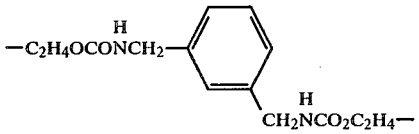 | bluish purple |
| 13 | n-$C_8H_{17}$ | $CH_3$ | $C_2H_5$ | $C_2H_5$ | H | H | 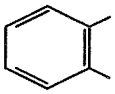 | $(CH_2)_2O(CH_2)_2$ | bluish purple |
| 14 | n-$C_8H_{17}$ | $CH_3$ | $C_2H_5$ | $C_2H_5$ | H | H | 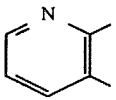 | $(CH_2)_4$ | blue |

-continued

Compound of formula (I) (wherein —O—R—O— is at the m-position with respect to $R_3R_4N$—)

| Compound No. | $R_1$ | $R_2$ | $R_3$ | $R_4$ | $R_5$ | $R_7$ | A | R | Hue on Silica Gel |
|---|---|---|---|---|---|---|---|---|---|
| 15 | $C_2H_5$ | $CH_3$ | $C_2H_5$ | $C_2H_5$ | H | H | 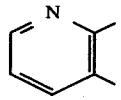 | $\leftarrow CH_2 \rightarrow_{10}$ | blue |
| 16 | n-$C_8H_{17}$ | H | $C_2H_5$ | $C_2H_5$ | H | H | 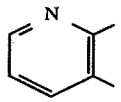 | $\leftarrow CH_2 \rightarrow_2 O \leftarrow CH_2 \rightarrow_2$ | bluish purple |
| 17 | $C_2H_5$ | $CH_3$ | $C_2H_5$ | $C_2H_5$ | H | H | 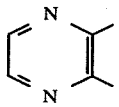 | $\leftarrow CH_2 \rightarrow_{10}$ | blue |
| 18 | 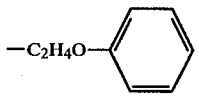 | $CH_3$ | $C_2H_5$ | $C_2H_5$ | H | H | 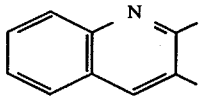 | $\leftarrow CH_2 \rightarrow_4$ | blue |

Compound of formula (II) (wherein $R_6$ is at the m-position with respect to 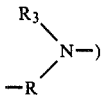 )

| Compound No. | $R_1$ | $R_2$ | $R_3$ | $R_5$ | $R_6$ | $R_7$ | A | R | Hue on Silica Gel |
|---|---|---|---|---|---|---|---|---|---|
| 19 | $C_2H_5$ | $CH_3$ | $C_2H_5$ | H | $OC_2H_5$ | H | 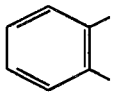 | $-(CH_2)_4-$ | bluish purple |
| 20 | $C_2H_5$ | $CH_3$ | $C_2H_5$ | H | $OC_2H_5$ | H | 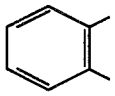 | $-(CH_2)_2O(CH_2)_2-$ | bluish purple |
| 21 | n-$C_8H_{17}$ | $CH_3$ | $C_2H_5$ | H | $OCH_3$ | H | 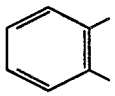 | $-(CH_2)_{10}-$ | bluish purple |
| 22 | $C_2H_5$ | $CH_3$ | $C_2H_5$ | H | 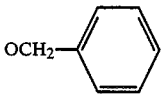 | H | 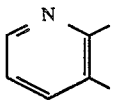 | $-(C_2H_4O)_2C_2H_4-$ | blue |
| 23 | n-$C_8H_{17}$ | $CH_3$ | $C_2H_5$ | H | $OC_2H_5$ | H | 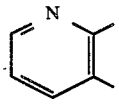 | $-(CH_2)_4-$ | blue |

Compound of formula (III) (wherein $R_6$ is at the m-position with respect to 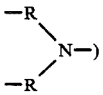 )

| Compound No. | $R_1$ | $R_2$ | $R_5$ | $R_6$ | $R_7$ | A | R | Hue on Silica Gel |
|---|---|---|---|---|---|---|---|---|
| 24 | $C_2H_5$ | $CH_3$ | H | $OC_2H_5$ | H | 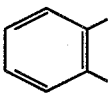 | $-C_2H_4-$ | bluish purple |
| 25 | $nC_8H_{17}$ | $CH_3$ | H | $OC_2H_5$ | H | 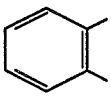 | $-C_2H_4-$ | bluish purple |

Compound of formula (IV) (wherein $R_6$ is at the m-position with respect to 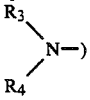 )

| Compound No. | $R_2$ | $R_3$ | $R_4$ | $R_5$ | $R_6$ | $R_7$ | A | R | Hue on Silica Gel |
|---|---|---|---|---|---|---|---|---|---|
| 26 | $CH_3$ | $C_2H_5$ | $C_2H_5$ | H | $OC_2H_5$ | H | 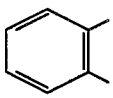 | $-(CH_2)_6-$ | bluish purple |

-continued

Compound of formula (IV) (wherein $R_6$ is at the m-position with respect to

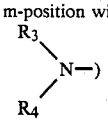

| Compound No. | $R_2$ | $R_3$ | $R_4$ | $R_5$ | $R_6$ | $R_7$ | A | R | Hue on Silica Gel |
|---|---|---|---|---|---|---|---|---|---|
| 27 | $CH_3$ | $C_2H_5$ | $C_2H_5$ | H | $OC_2H_5$ | H | 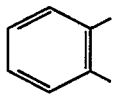 | $-(CH_2)_{10}-$ | bluish purple |
| 28 | $CH_3$ | $C_2H_5$ | $C_2H_5$ | H | $OC_2H_5$ | H | 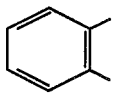 | $-(C_2H_4O)_2C_2H_4-$ | bluish purple |
| 29 | $CH_3$ | n-$C_4H_9$ | n-$C_4H_9$ | H | $OC_2H_5$ | H | 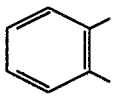 | $-(CH_2)_4-$ | bluish purple |
| 30 | $CH_3$ | $C_2H_5$ | $C_2H_5$ | H | 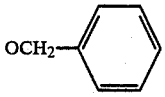 | H | 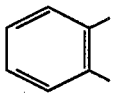 | $-(CH_2)_2-O-(CH_2)_2-$ | bluish purple |
| 31 | $CH_3$ | $C_2H_5$ | $C_2H_5$ | H | 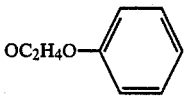 | H | 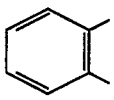 | $-(CH_2)_4-$ | bluish purple |
| 32 | $CH_3$ | $C_2H_5$ | $C_2H_5$ | H | $OC_2H_5$ | H | 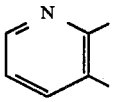 | $-(CH_2)_{10}-$ | blue |
| 33 | H | $C_2H_5$ | $C_2H_5$ | H | 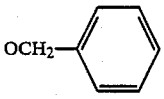 | H | 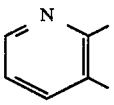 | $-(CH_2)_2-O-(CH_2)_2-$ | bluish purple |
| 34 | H | $C_2H_5$ | $C_2H_5$ | H | $OC_2H_5$ | H | 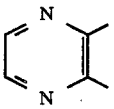 | $-(CH_2)_{10}-$ | bluish purple |

These novel colorless dyes each can constitute a recording material in combination with various already well-known compounds, such as triarylmethane compounds, fluoran compounds, thiazine compounds, indolylazalphthalide compounds, leuco auramine compounds, xanthene compounds, diphenylmethane compounds, triazene compounds, spiropyran compounds, and so on.

In using the colorless dyes of the present invention in combination with the foregoing known compounds, it is to be desired from the standpoint of improvements in characteristics that the fraction of the colorless dyes comprised by dyes of formulae (I) to (IV) should be 40 wt% or more.

Specific examples of triarylmethane compounds which can be used in combination with the dyes of formulae (I) to (IV) include 3,3-bis(p-dimethylaminophenyl)-6-dimethylaminophthalide (i.e., Crystal Violet lactone), 3,3-bis(p-dimethylaminophenyl)phthalide, 3-(p-diethylamino-2-ethoxyphenyl)-3-(1,2-dimethylindol-3-yl)phthalide, 3-(p-diethylamino-2-buthoxyphenyl)-3-(1-octyl-2-methylindol-3-yl)phthalide, and so on.

Specific examples of diphenylmethane compounds which can be used in combination with the colorless dyes of formulae (I) to (IV) include 4,4'-bis-dimethylaminobenzhydrin benzyl ether, and so on.

Specific examples of leuco auramine compounds which can be used in combination with the dyes of formulae (I) to (IV) include an N-halophenyl-luecoauramine, N-2,4,5-tri-chlorophenyl-leuco-auramine, and so on.

Specific examples of xanthene compounds which can be used in combination with the dyes of formulae (I) to (IV) include Rhodamine-B-anilinolactam, Rhodamine-(p-nitro-anilino)lactam, and Rhodamine-B-(p-chloroanilino)lactam.

Specific examples of fluoran compounds which can be used in combination with the dyes of formulae (I) to (IV) include 2-dibenzylamino-6-diethylaminofluoran, 2-anilino-6-di-ethylaminofluoran, 2-anilino-3-methyl-6-diethylamino-fluoran, 2-anilino-3-methyl-6-cyclohexylmethylamino-fluoran, 2-o-chloroanilino-6-diethylaminofluoran, 2-m-chloroanilino-6-diethylaminofluoran, 2-(3,4-dichloro-anilino)-6-diethylaminofluoran, 2-octylamino-6-diethyl-aminofluoran, 2-dihexylamino-6-diethylaminofluoran, 2-m-trifluoromethylanilino-6-diethylaminofluoran, 2-butylamino-3-chloro-6-diethylaminofluoran, 2-ethoxyethylamino-3-chloro-6-diethylaminofluoran, 2-p-chloroanilino-3-methyl-6-dibutylaminofluoran, 2-anilino-3-methyl-6-dioctylaminofluoran, 2-anilino-3-chloro-6-diethylaminofluoran, 2-diphenylamino-6-diethylaminofluoran, 2-anilino-3-methyl-6-diphenylaminofluoran, 2-phehyl-6-diethylaminofluoran, 2-anilino-3-methyl-6-N-ethyl-N-isoamylaminofluoran, 2-anilino-3-methyl-5-chloro-6-diethylaminofluoran, 2-anilino-3-methyl-6-diethylamino-7-methylfluoran, 2-anilino-3-methoxy-6-dibutylaminofluoran, 2-o-chloranilino-6-dibutylaminofluoran, 2-p-chloroanilino-3-ethoxy-6-N-ethyl-N-isoamylaminofluoran, 2-o-chloroanilino-6-p-butylanilinofluoran, 2-anilino-3-pentadecyl-6-diethylaminofluoran, 2-anilino-3-ethyl-6-dibutylaminofluoran, 2-anilino-3-methyl-4',5'-dichloro-fluoran, 2-o-toluidino-3-methyl-6-diisopropylamino-4',5'-dimethylaminofluoran, 2-anilino-3-ethyl-6-N-ethyl-N-isoamylaminofluoran, 2-anilino-3-methyl-6-N-ethyl-N-η-methoxypropylaminofluoran, 2-anilino-3-chloro-6-N-ethyl-N-isoamylaminofluoran, 3,6-bis(diphenylamino)-fluoran, 3,6-bisethoxyfluorane, and so on.

Specific examples of thiazine compounds which can be used in combination with the colorless dyes of formulae (I) to (IV) include benzoyl lueco Methylene Blue, p-nitrobenzoyl lueco Methylene Blue, and so on.

Specific examples of spiropyran compounds which can be used in combination with the colorless dyes of formulae (I) to (IV) include 3-methyl-spirodinaphthopyran, 3-ethyl-spiro-dinaphthopyran, 3,3'-dichlorospiro-dinaphthopyran, 3-benzyl-spiro-dinaphthopyran, 3-methyl-naphtho-(3-methoxybenzo)spiropyran, 3-propyl-spiro-dibenzopyran, and so on.

These compounds well-known as colorless dyes are described, for example, in U.S. Pat. Nos. 3,491,111, 3,491,112, 3,491,116, 3,509,174, 3,624,107, 3,627,787, 3,641,011, 3,462,828, 3,681,390, 3,920,510, 3,959,571, 3,971,808, 3,775,424, 3,853,869, 4,246,318, etc.

Electron-accepting compounds, hereinafter referred to as color developers, which can give coloration by contact with the colorless dyes and which are used in the present invention include inorganic and organic lewis acids and Brønsted acids. Specifically, they include phenol derivatives, salicylic acid derivatives, metal salts of aromatic carboxylic acids, acid clay, bentonite, novolak resins, and metal-processed novolak resins.

Specific examples of color developers include phenol derivatives, e.g., hexyl-4-hydroxybenzoate, 2,2'-dihydroxybiphenyl, 2,2-bis-(4-hydroxyphenyl)propane (i.e., bisphenol A), 4,4'-isopropylidenebis(2-methylphenol), 1,1-bis-4-hydroxyphenyl)cyclohexane, 1,1-bis(3-chloro-4-hydroxy-phenyl)2-ethyl-butane, 4,4'-sec-isooctylidenediphenol, 4-tert-octylphenol, 4,4'-sec-butylidenediphenol, 4-p-methylphenylphenol, 4,4'-isopentylidenediphenol, 4,4'-methylcyclohexylidenediphenol, 4,4'-dihydroxydiphenyl sulfide, 1,4-bis-4'-hydroxycumylbenzene, 1,3-bis-4'-hydroxycumylbenzene, 4,4'-thiobis-(6-tert-butyl-3-methylphenol), 4,4'-dihydroxydiphenyl sulfone, 4,4-dihydroxydiphenyl sulfone mono isopropyl ether, bis(3-allyl-4-hydroxyphenyl)sulfone, bis(3-methyl-4-hydroxyphenyl)sulfone, hydroquinone monobenzyl ether, 4-hydroxybenzophenone, 2,4-di-hydroxybenzophenone, polyvinylbenzyloxycarbonylphenol, 2,4,4'-trihydroxybenzophenone, 2,2',4,4'-tetrahydroxy-benzophenone, dimethyl 4-hydroxyphthalate, methyl 4-hydroxybenzoate, 2,4,4'-trihydroxydiphenyl sulfone, 1,5-bis-p-hydroxyphenylpentane, 1,6-bis-p-hydroxyphenoxy-hexane, tolyl 4-hydroxybenzoate, α-phenylbenzyl-4-hydroxybenzoate, phenylpropyl 4-hydroxybenzoate, phenethyl 4-hydroxybenzoate, p-chlorobenzyl 4-hydroxybenzoate, p-methoxybenzyl 4-hydroxybenzoate, benzyl 4-hydroxybenzoate, m-chloro-benzyl 4-hyroxybenzoate, β-phenethyl 4-hydroxybenzoate, 4-hydroxy-2',4'-dimethyl-diphenyl sulfone, β-phenethyl orsellinate, cinnamyl orsellinate, o-chlorophenoxyethyl orsellinate, o-ethylphenoxyethyl orsellinate, o-phenylphenoxyethyl orsellinate, m-phenylphenoxyethyl orsellinate, β-3'-tert-butyl-4'-hydroxy-phenoxyethyl 2,4-dihydroxybenzoate, 1-tert-butyl-4-p-hydroxyphenylsulfonyloxybenzene, 4-N-benzylsulfamoylphenol, p-methyl-benzyl 2,4-dihydroxybenzoate, β-phenoxyethyl 2,4-dihydroxybenzoate, benzyl 2,4-dihydroxy-6-methylbenzoate, methyl bis-4-hydroxyphenylacetate, ditolyl thiourea, and 4,4'-diacetyldiphenyl thiourea, etc.; salicylic acid derivatives, e.g., 3-phenylsalicylic acid, 3-cyclohexylsalicylic acid, 3,5-di-tert-butylsalicylic acid, 3,5-di-dodecylsalicylic acid, 3-methyl-5-benzylsalicylic acid, 3-phenyl-5-(α,α-dimethylbenzyl)salicylic acid, 3,5-bis-(α-methylbenzyl)salicylic acid, and 3,5-dicyclopenta-dienylsalicylic acid, 5-phenyl-3-(α,α-dimethylbenzyl)salicylic acid, 5-t-octylsalicylic acid, 3-chloro-5-cumylsalicylic acid, 3-methyl-5-t-octylsalicylic acid, 3-methyl-5-α-methylbenzylsalicylic acid, 3-methyl-5-cumylsalicylic acid, 3,5-di-t-amylsalicylic acid, 3-phenyl-5-benzylsalicylic acid, 3-phenyl-5-t-octylsalicylic acid, 3-phenyl-5-α-methylbenzylsalicylic acid, 3,5-di-t-octylsalicylic acid, 3,5-dicumylsalicylic acid, 5-triphenylmethylsalicylic acid, 5-diphenylmethylsalicylic acid, 4-n-pentadecylsalicylic acid, 5-(1,3-diphenylbutyl)salicylic acid, 5-n-octadecylsalicylic acid, 5-dodecylsulfonylsalicylic acid, 3-t-butyl-5-α-methylbenzylsalicylic acid, 3-t-butyl-5-α,α-dimethylbenzylsalicylic acid, 5-α-methyl(α-phenylethyl)benzylsalicylic acid, 3,5-dicyclohexylsalicylic acid, 4-β-(p-methoxyphenoxy)ethoxysalicylic acid, etc.; aromatic carboxylic acid derivatives such as 2-hydroxy-1-benzyl-3-naphthoic acid, pentachlorobenzoic acid, pentafluorobenzoic acid, 3-nitrobenzoic acid, 4-nitro-benzoic acid, 2-β-hydroxyethoxycarbonyltetrachlorobenzoic acid, etc.; benzoic acid, p-tert-butylbenzoic acid, phthalic acid, gallic acid, etc.; aliphatic carboxylic acids such as oxalic acid, maleic acid, tartaric acid, citric acid, succinic acid, and stearic acid, etc.; and phenol resins such as p-phenylphenol-formaldehyde resin, p-butylphenol-acetylene resin, a carboxy-modified product of terpene phenol resins comprising a gum turpentine and a phenol, and a carboxy-modified product of terpene addition phenol comprising a dipentene (2 mol) and a phenol (1 mol); salts of these organic color developers and polyvalent metals such as zinc, magnesium, aluminium, calcium, titanium, manganese, tin, nickel, etc.; inorganic color developers including inorganic acids such as hydrohalogenic acids (e.g., hydrochloric acid, hydrobromic acid, and hydroiodic acid), boric acid, silicic acid, phosphoric acid, sulfuric acid, nitric acid, perchloric acid, and metal halides of a metal such as aluminium, zinc, nickel, tin, or titanium, and a halogen such as boron and the like, acid clay, activated clay, attapulgite, bentonite, colloidal silica, aluminium silicate, magnesium silicate, zinc silicate, tin silicate, zinc rhodanide, zinc chloride, iron stearate, cobalt naphthenate, nickel peroxide, ammonium nitrate and the like, and so on. These electron-accepting compounds may be used alone or as a mixture of two or more thereof.

Among these electron-accepting compounds, phenol derivatives having 12 or more carbon atoms and salicylic acid derivatives having 15 or more carbon atoms or metal salts thereof are preferably used together with the colorless dyes of formulae (I) to (IV) of the present invention in view of light fastness of the color developed image. The salicylic acid derivatives are preferably disubstituted salicylic acid derivatives. Substituents for the salicylic acid derivatives include an alkyl group having 1 to 18 carbon atoms, an aralkyl group having 7 to 20 carbon atoms, an alicyclic group, an alkoxy group having 1 to 18 carbon atoms, which may be substituted, an aryl group, an arylsulfonyl group, and a halogen atom, etc.

In applying the foregoing colorless dyes and electron-accepting compounds each to a recording material, they are used in the form of fine dispersion or fine droplets.

When used for pressure-sensitive paper, the colorless dyes and the elcrtron-accepting compounds can assume various forms, such as those described in prior patents, e.g., U.S. Pat. Nos. 2,505,470, 2,505,471, 2,505,489, 2,548,366, 2,712,507, 2,730,456, 2,730,457, 3,103,404, 3,418,250 and 4,010,038, and so on. Quite commonly, a recording material is made up of at least a pair of sheets one of which contains an electron-donating colorless dye and the other of which contains an electron-accepting compound.

As methods for encapsulation, there are known the methods described in U.S. Pat. Nos. 2,800,457 and 2,800,458, in which coacervation of hydrophilic colloid sol is utilized; interfacial polymerization methods as described in British Pat. Nos. 867,797, 950,443, 989,264 and 1,091,076, and so on; the technique described in U.S. Pat. No. 3,103,404; and so on.

In general, one or more of the foregoing electron-donating colorless dyes are dissolved in a solvent (e.g., synthetic oils, such as alkylated naphthalene, alkylated diphenyl, alkylated diphenylmethane, alkylated terphenyl, chlorinated paraffin, etc.; vegetable oils, such as cotton seed oil, castor oil, etc.; animal oils; mineral oils; or mixtures of two or more thereof), microencapsulated, and coated on a support, such as paper, wood free paper, a plastic sheet, resin-coated paper or the like, to prepare a color former sheet. As for the support to be used, neutralized paper is particularly desirable.

One or more of the foregoing electron-accepting compounds alone or together with other electron-accepting compounds are dispersed into a binder such as a styrenebutadiene latex, polyvinyl alcohol or the like, and coated together with a pigment described hereinafter on a support, such as paper, plastic sheet, resin-coated paper or the like, to prepare a color developer sheet.

The amounts of electron-donating colorless dyes and electron-accepting compounds to be used in the present invention depend on an intended thickness of the coat, the form of the pressure-sensitive copying paper, the method of preparation of microcapsules, and other conditions. The amount of each may be properly chosen according to desired use and conditions. Determination of the proper amounts is easy to one skilled in the art.

When used for heat-sensitive paper, the electron-donating colorless dyes and the electron-accepting compounds are ground to fine particles having a diameter of 10 microns or less, preferably 3 microns or less, and dispersed in a dispersion medium. In general, an aqueous solution containing a water-soluble high polymer in a concentration of about 0.5 to 10% is used as the dispersion medium, and dispersion is carried out using a ball mill, a sand mill, a horizontal type sand mill, an attritor, a colloid mill, or the like. In the case of heat-sensitive recording materials, the electron-donating colorless dyes and the electron-accepting compounds can be preferably used at a weight ratio of from about 1:20 to 1:1, and more preferably from about 1:10 to 2:3.

In the preparation of the dispersion, it is preferable to use, in combination with the electron-donating colorless dyes or the electron-accepting compounds, heat-fusible compounds having a melting point of 75° C. to 130° C., such as nitrogen-containing organic compounds, e.g., fatty acid amides, acetoacetic anilide, diphenylamine, benzamide, carbazole, etc.; 2,3-di-m-tolylbutane, o-fluorobenzoyldurene, chlorobenzoylmesitylene, 4,4'-dimethylbiphenyl; carboxylic acid esters, e.g., dimethyl isophthalate, diphenyl phthalate, dimethyl terephthalate, methacryloxybiphenyl, etc.; polyether compounds, e.g., di-m-tolyloxyethane, β-phenoxyethoxyanisole, 1-phenoxy-2-p-ethylphenoxyethane, bis-β-(p-methoxyphenoxy)ethoxymethane, 1-2'-methylphenoxy-2,4'-ethylphenoxyethane, 1-tolyloxy-2-p-methyl-phenoxyethane, 1,2-diphenoxyethane, 1,4-diphenoxybutane, bis-β-naphthoxy-2-ethyl ether, 1-phenoxy-2-p-chlorophenoxyethane, 1,2'-methylphenoxy-2,4''-ethyloxyphenoxyethane, 1-4'-methylphenoxy-2,4''-fluorophenoxyethane, bis-β-(p-methoxyphenoxy)ethyl ether, 1,2-bis(p-methoxyphenylthio)ethane, N-benzyl phenyl acetoamide, etc. These compounds are finely dispersed together with either the electron-donating colorless dyes or the electron-accepting compounds. In particular, it is preferred to disperse these compounds and the colorless dyes at the same time from the standpoint of prevention of fog. They are used in a proportion of 20 to 300% by weight, preferably 40 to 150% by weight, based on the weight of the electron-accepting compounds.

To the thus obtained coating composition are further added additives for the purpose of satisfying various particular requirements.

As an example of additives, mention may be made of an oil absorbing substance, such as an inorganic pigment, polyurea filler, etc., which is dispersed in a binder in order to prevent the contamination of a recording head upon recording. As another example of additives, a fatty acid, a metal soap or the like is used in order to improve release characteristics toward a recording head. Further, additives including pigments, waxes, an antistatic agent, an ultraviolet absorbent, a defoaming agent, a conductivity imparting agent, a brightening dye, a surface active agent and so on are generally coated on a support in addition to the electron-donating colorless dyes and the electron-accepting compounds which both contribute directly to color development, thus constituting a recording material.

Specific examples of pigments which can be used in the present invention include kaolin, calcined kaolin, talc, agalmatolite, zinc oxide, calcium carbonate, aluminium hydroxide, magnesium oxide, calcined plaster, silica, magnesium carbonate, titanium oxide, alumina, barium carbonate, barium sulfate, mica, microballoon, urea-formaldehyde filler, polyethylene particles, cellulose filler and so on, whose particle sizes are adjusted to 0.1 to 15 microns.

Specific examples of waxes which can be used in the present invention include paraffin wax, carboxy-modified paraffin wax, carnauba wax, microcrystalline wax, polyethylene wax, and higher fatty acid esters.

Specific examples of metal soaps which can be used in the present invention include polyvalent metal salts of higher fatty acids, such as zinc stearate, aluminium stearate, calcium stearate, zinc oleate and the like.

These additives are dispersed into a binder, and coated. As for the binder, water-soluble binders are generally employed. Specific examples of such binders include polyvinyl alcohol, hydroxyethyl cellulose, hydroxypropyl cellulose, epichlorohydrin-modified polyamide, ethylene-maleic anhydride copolymer, styrene-maleic anhydride copolymer, isobutylene-maleic anhydride copolymer, polyacrylic acid, polyacrylamide, methylol-modified polyacrylamide, starch derivatives, casein, gelatin and so on. For the purpose of imparting water-resisting property to these binders, a water resistance-imparting agent (e.g., a gelling agent, a cross-linking agent or so on), or an emulsion of a hydrophobic polymer, such as a styrene-butadiene rubber latex, an acrylic resin emulsion or the like, can be added. The thus prepared coating composition is coated on base paper, wood free paper, plastic sheet, synthetic paper or neutralized paper at a coverage of about 2 to 10 g/m$^2$.

Further, a protective layer about 0.2 to 2 microns thick, which is comprised of a water-soluble or water-dispersible micromolecular compound, such as polyvinyl alcohol, hydroxy-ethyl starch or epoxy-modified polyacrylamide, and a cross-linking agent, can be provided on the surface of the coated layer to enhance resistance.

When applied to heat sensitive paper, the recording material of the present invention can further have various embodiments as described in West German Patent Application (OLS) Nos. 2,228,581 and 2,110,854, Japanese Patent Publication No. 20142/77, and so on. In addition, a pre-heating, humidity control, stretching or like procedure can be given to the coated paper prior to recording.

Electro thermo-recording paper is produced according to the methods as described in Japanese Patent Application (OPI) Nos. 11344/74 and 48930/75, and so on. In general, the electro thermo-recording paper is produced by coating on a support such as paper a coating composition in which a conductive substance, an electron-donating colorless dye, and an electron-accepting compound are dispersed together with a binder, or by coating on a support a conductive substance to form a conductive layer, and coating thereon a coating composition in which an electron-donating colorless dye, an electron-accepting compound and a binder are dispersed. Further, a heat fusible compound as described hereinbefore can be used together with the above-described constituents in order to heighten the sensitivity.

Light- and pressure-sensitive paper is produced according to the methods as described, e.g., in Japanese Patent Application (OPI) No. 179836/82. In general, a photopolymerization initiator, e.g., silver iodobromide, silver bromide, silver behenate, Michler's ketone, a benzoin derivative, a benzophenone derivative or so on, and a cross-linking agents, e.g., a polyfunctional monomer like a polyallyl compound, poly(meth)acrylate, poly(meth)acrylamide, or so on, are enclosed together with the colorless dyes, and optionally a solvent, in capsules whose wall is made up of a synthetic resin, e.g., polyether urethane, polyurea or the like. After image-wise exposure, the colorless dyes present in unexposed areas, when brought into contact with a color developer (electron-accepting compound), result in coloration.

The electron-donating colorless dyes of the present invention may be prepared in accordance with known processes such as disclosed in U.S. Pat. Nos. 3,829,322 and 4,062,866. For instance, a corresponding benzoylbenzoic acid or benzoylpyridine carboxylic acid is made to react with indole dimer, or a corresponding carboxybenzoylindole or carboxypyridinecarbonylindole is made to react with an aniline dimer derivative in the pressure of a condensing agent, such as acetic anhydride, phosphorus oxychloride or so on, if necessary, using a volatile organic inert solvent, such as chloroform, benzene, chlorobenzene, etc., at a reaction temperature from 50° C. to 140° C. for 10 to 120 minutes. The reaction mixture is poured into ice-cold water to hydrolize the condensing agent, the volatile organic inert solvent is further added thereto, the liquids are rendered alkaline by addition of an aqueous solution of sodium hydroxide, the solvent layer alone is taken out, and the solvent is distilled away under reduced pressure to obtain the intended colorless dye.

The electron-donating colorless dyes of the present invention can be synthesized preferably by a process comprising reacting an aminophenol dimer derivative represented by formula (V):

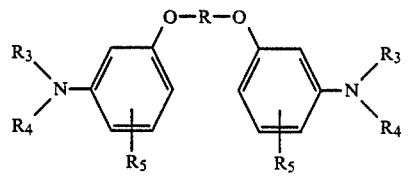

(V)

wherein R, $R_3$, $R_4$, and $R_5$ are as defined above, with a carboxybenzoylindole derivative represented by formula (VI):

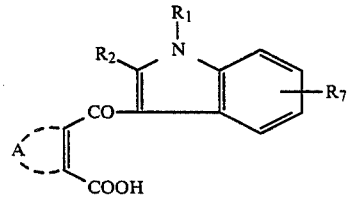

(VI)

wherein $R_1$, $R_2$, $R_7$, and A are as defined above, or a process comprising reacting a ketone derivative represented by formula (VII):

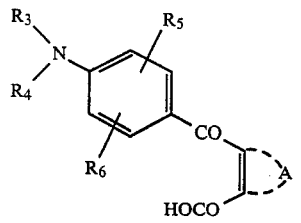

(VII)

wherein $R_3$, $R_4$, $R_5$, $R_6$, and A are as define above, with an indole dimer derivative represented by formula (VIII):

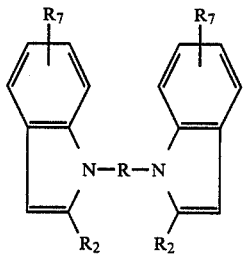

(VIII)

wherein R, $R_2$, and $R_7$ are as defined above.

The above-described reactions can be carried out in a known manner, for example, under the conditions disclosed in U.S. Pat. No. 4,062,866, and Japanese Patent Application (OPI) No. 168664/86, etc.

The aminophenol dimer derivative represented by formula (V) can be obtained by reacting an m-dialkylaminophenol derivative with a compound represented by formula (IX):

$$X'—R—X' \quad (IX)$$

wherein R is as defined above; and X' represents a halogen atom or Ar—$SO_2O$, wherein Ar represents an aryl group.

The indole dimer derivative of formula (VIII) can be obtained by reacting a 1H-indole derivative with the compound represented by formula (IX).

The synthesis of the colorless dyes according to the present invention will be illustrated by way of the following synthesis examples.

SYNTHESIS EXAMPLE 1

Synthesis of 3,3'-[Oxybis(2,1-Ethanediyloxy-(4-(Diethylamino)-2,1-Phenylene))]-Bis[3-[(2-Methyl-1-Ethyl)Indol-3-yl]-1(3H)-Isobenzofuranone]

In a flask quipped with a stirrer were charged 0.1 mol of m-diethylaminophenol, 0.048 mol of diethylene glycol ditosylate, and 0.1 mol of potassium carbonate, and 50 ml of sulforan was added thereto, followed by stirring under heating. The reaction mixture was poured into water to obtain 1,5-bis-m-diethylaminophenoxy-2-oxapentane as a liquid. The resulting aniline derivative (0.05 mol) and 0.05 mol of 3-o-carboxylbenzoyl-1-ethyl-2-methylindole obtainable by reacting 1-ethyl-2-methylindole and phthalic anhydride were placed in a flask, and acetic anhydride was added thereto, followed by heating. The reaction immediately proceeded, and the system assumed bluish purple. The reaction mixture was poured into water, and the mixture was subjected to column chromatography using chloroform-ethyl acetate as an eluent to obtain the desired product as a white crystal having a melting point of 191°-194° C.

SYNTHETIC EXAMPLE 2

Synthesis of 3,3'-[1,4-Butanedioxybis(4-(Diethylamino)-2,1-Phenylene)]-Bis[3-[(2-Methyl-1-Ethyl)Indol-3-yl]-1(3H)-Isobenzofuranone]

Reaction was carried out in the same manner as described in Synthesis Example 1, except for replacing diethylene glycol ditosylate with 1,4-butanediol ditosylate. The reaction mixture was subjected to column chromatography to obtain the desired product as a white crystal having a melting point of 140° C.

SYNTHESIS EXAMPLE 3

Synthesis of 3,3'-[1,10-Decanedioxybis(4-(Diethylamino)-2,1-Phenylene)]-Bis[3-[(2-Methyl-1-Ethyl)Indol-3-yl]-1(3H)-Isobenzofuranone]

Reaction was carried out in the same manner as described in Synthesis Example 1, except for replacing diethylene glycol ditosylate with 1,10-di-bromodecane. The reaction mixture was subjected to column chromatography to obtain the desired product as a white crystal having a melting point of 116°-118° C.

SYNTHESIS EXAMPLE 4

Synthesis of 3,3'-[1,10-Decanediylbis(2-Methylinodol-1,3-diyl)-]bis[3-[4-Diethylamino)-2-Ethoxyphenyl]-1(3H)-Isobenzofuranone]

In a flask equipped with a stirrer were charged 0.2 mol of 2-methylindole, 0.1 mol of 1,10-dibromobutane, and 0.3 mol of potassium hydroxide, and 50 ml of dimethyl sulfoxide was added thereto, followed by stirring at 30° C. for 4 hours. The reaction mixture was poured into water and extracted with n-hexane to obtain a bisindole compound as a liquid. The resulting bisindole compound (0.08 mol) and 0.24 mol of phthalic anhydride were placed in a flask equipped with a stirrer, and 50 ml of glacial acetic acid was added thereto, followed by stirring at 60° C. for 4 hours. The reaction mixture was poured into water. The precipitated crystal was collected by filtration and washed with hot water. The thus recovered bis-carboxybenzoylindole compound (0.05 mol) and 0.1 mol of m-diethylaminophenetidine were charged in a flask, and acetic anhydride was added thereto, followed by heating at 60° C. for 4 hours. The reaction mixture was poured into water and extracted with ethyl acetate. The extract was subjected to silica gel column chromatography using ethyl acetate-n-hexane as a eluent to obtain the desired product as a white crystal having a melting point of 108°-110° C.

The present invention will now be illustrated in more detail by reference to the following examples and comparative examples. However, the invention should not be construed as being limited to the following examples. Unless otherwise indicated, all parts, percents and ratios are by weight.

EXAMPLE 1 TO 4

(1) Preparation of a developer sheet:

Ten parts of zinc 3,5-bis(α-methylbenzyl)salicylate was added to 20 parts of 1-isopropylphenyl-2-phenylethane and heated at 90° C. and dissolved. The resulting solution was added to 50 parts of a 2% aqueous solution of polyvinyl alcohol ("PVA-117" manufactured by Kuraray Co., Ltd. (molecular weight: 75,000)), and 0.1 part of 10% aqueous solution of triethanol amine of dodecylbenzene sulfonate was further added thereto as a surfactant. An emulsion having a particle diameter of 3 μm was prepared by a homogenizer.

Eighty parts of calcium carbonate, 20 parts of zinc oxide, 1 part of sodium hexamethaphosphate and 200 parts of water was dispersed by a kady mill for 10 minutes to prepare a dispersion and then the above-described emulsion was added thereto. Thereafter, 100 parts of 10% aqueous solution of PVA-117 (manufactured by Kuraray Co., Ltd.) and 10 parts by solids content of carboxy-modified SBR lated ("SN-307", manufactured by Sumitomo Naugatuc Co., Ltd.) as a binder were added, and water was added to the mixture to adjust solids content to a concentration of 20%, to prepare coating solution (A).

Ten parts of the developer, 20 parts of silton clay, 60 parts of calcium carbonate, 20 parts of zinc oxide, 1 part of sodium hexamethaphosphate and 200 parts of water were mixed and uniformly dispersed by a sand grinder to prepare a dispersion having an average particle diameter of 3 μm.

To the thus-obtained dispersion, 16 parts of a 10% aqueous solution of PVA-103 (manufactured by Kuraray Co., Ltd.) and 100 parts of a 10% aqueous solution of PVA-117 (manufactured by Kuraray Co., Ltd.) and 10 parts by solids content of carboxy-modified SBR latex ("SN-307", manufactured by Sumitomo Naugatuc Co., Ltd.) were added, and thereafter water was added to adjust the solids concentration of the dispersion to 20%, to prepare coating solution (B).

The coating solutions (A) and (B) were mixed in a mixing ratio of A/B=50/50 in terms of the amount of the developer and coated on a base pater (50 g/m$^2$) by an air knife coater to a solids content of 5.0 g/m$^2$, and then dried to obtain a developer sheet.

(2) Preparation of a color former sheet:

Five parts of sodium polyvinylbenzene sulfonate ("VERSA, TL 500", manufactured by National Starch Co., Ltd. (average molecular weight: 500,000)) was dissolved in 95 parts of hot water having a temperature of about 80° C. with stirring. After it was dissolved for about 30 minutes, it was cooled. The aqueous solution had a pH of from 2 to 3, and a 20 wt% aqueous solution of sodium hydroxide was added thereto to adjust the pH to 4.0. Then, 100 parts of diisopropyl naphthalene having dissolved therein the color former shown in Table (electron-donating colorless dye) in an amount of 3.5% was added to 100 parts of a 5% aqueous solution of sodium polyvinylbenzene sulfonate prepared above, emulsified and dispersed to obtain an emulsion having an average particle size (diameter) of 4.5 μm. Six parts of melamine, 11 parts of a 37 wt% aqueous solution of formaldehyde and 30 parts of water were mixed and heated at 60° C. with stirring and after 30 minutes, a mixed aqueous solution of transparent melamine, formaldehyde and an initially condensed product of melamine and formaldehyde were obtained. The mixed aqueous solution had a pH of from 6 to 8. Hereinafter, the mixed aqueous solution of melamine, formaldehyde and the initially condensed product of melamine-formaldehyde is referred to as the "initially condensed solution". Forty-seven parts of the initially condensed solution thus obtained was added to the above-described emulsion, mixed and while stirring, the pH thereof was adjusted to 6.0 by the addition of a 3.6 wt% phosphoric acid solution and the solution was heated to 65° C. with stirring for 360 minutes. The thus-obtained microcapsule solution was cooled to room temperature, and the pH thereof wad adjusted to 9.0 by the addition of a 20 wt% aqueous solution of sodium hydroxide.

Then, 200 parts of a 10 wt% aqueous solution of polyvinyl alcohol (molecular weight: 20,000) and 50 parts of starch particles (size: 15 μm) were added to the microcapsule solution, and water was added thereto to adjust the solids content concentration to 20% to obtain a coating solution containing a microcapsule dispersion.

The coating solution was coated on a base paper (50 g/m$^2$) in a coating amount of 5 g/m$^2$ by solids content by an air knife coater, and dried to obtain a color former sheet according to the present invention.

The thus obtained color former sheet and the developer sheet were superposed with the coated layers in contact, and upon pressure of 600 kg/cm$^2$ blue printed images were immediately obtained.

The image was covered with a transparent polyvinyl chloride sheet and exposed to sunlight let in through a window for 4 weeks. The color density after the light exposure was measured by a Macbeth RD-918 densitometer and compared with that before the light exposure to obtain a residual percentage of color from equation:

$$\text{Residual Percentage of Color Formed} = \frac{\text{Color Density After Exposure}}{\text{Color Density Before Exposure}} \times 100(\%)$$

The light fastness of the image was rated according to the following scale:

A: Residual percentage of color formed is 75% or more.

B: Residual percentage of color formed is from 50 to 75%.

C: Residual percentage of color formed is from 25 to 50%.

D: Residual percentage of color formed is 25% or less.

COMPARATIVE EXAMPLES 1 AND 2

The same procedure as in Examples 1 to 4 was repeated to prepare a color former sheet and a developer sheet using the color former and the developer shown in Table. Color image were formed in the same manner as in Example 1 and the same light fastness tests were carried out. The results are shown in Table.

TABLE 1

| | Electron-Donating Colorless Dye | Light-Fastness |
|---|---|---|
| Example No. | | |
| 1 | Compound No. 2 | A |
| 2 | Compound No. 3 | A |
| 3 | Compound No. 11 | A |
| 4 | Compound No. 27 | B |
| Comparative Example No. | | |
| 1 | Crystal Violet Lactone | D |
| 2 | 3-[4-(Diethylamino)-2-ethoxyphenyl]-3-[(2-methyl-1-ethyl)indol-3-yl]-1(3H)—isobenzofuranone | C |

It can be seen from the results of Table 1 that the recording materials according to the present invention are apparently excellent in image fastness to light when preserved in a polyvinyl chloride file.

EXAMPLE 5

Thirty parts of Compound No. 1 was mixed with 150 parts of a 10% aqueous solution of polyvinyl alcohol (molecular weight: 40,000) and 70 parts of water and pulverized in a ball mill for 12 hours. The resulting dispersion had a particle diameter of about 1.5 μm (Component A).

Thirty parts of zinc 4-β-(p-methoxyphenoxy)ethoxy salicylate, 30 parts of 2-benzyloxynaphthalene, 150 parts of a 10% aqueous solution of polyvinyl alcohol (molecular weight: 40,000) and 55 parts of water were mixed and pulverized in a sand mill to prepare a dispersion. The insoluble substance had a particle diameter of about 2 μm (Component B).

Five parts of component A and 40 parts of component B were mixed, coated on a paper and dried to obtain a heat-sensitive paper having a coating amount of 6 g/m$^2$ by solids.

Blue color was formed on the heat-sensitive paper where heat was applied by a thermal pen.

The resulting image had a high density and excellent fastness to light when preserved in a polyvinyl chloride file.

While the invention has been described in detail and with reference to specific embodiments thereof, it will be apparent to one skilled in the art that various changes and modifications can be made therein without departing from the spirit and scope thereof.

What is claimed is:

1. A recording material comprising an electron-donating colorless dye and an electron-accepting compound wherein said colorless dye is a dimer composed of 3-(4-substituted aminoaryl)-3-(substituted indol-3-yl)-phthalide moieties connected via an alkylene or alkenylene group having from 1 to 20 carbon atoms which may contain therein one or more of an oxygen atom or a nitrogen atom.

2. A recording material as claimed in claim 1, wherein said electron-accepting compound is a phenol derivative or a salicylic acid derivative.

3. A recording material as claimed in claim 2, wherein said electron-accepting compound is a phenol derivative having 12 or more carbon atoms or a salicylic acid derivative having 15 or more carbon atoms or a metal salt thereof.

4. A recording material as claimed in claim 2, wherein said salicylic acid derivative is a di-substituted salicylic acid zinc salt.

5. A recording material as claimed in claim 1, wherein said recording material is a pressure-sensitive recording material.

6. A recording material as claimed in claim 1, wherein said recording material is a heat-sensitive recording material.

7. A recording material comprising an electron-donating colorless dye and a an electron-accepting compound, wherein said colorless dye is selected from compounds represented by formula (I);

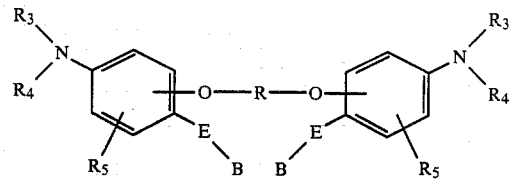

(I)

compounds represented by formula (II);

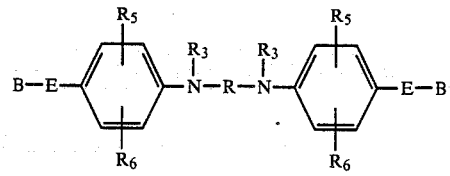

(II)

compounds represented by formula (III);

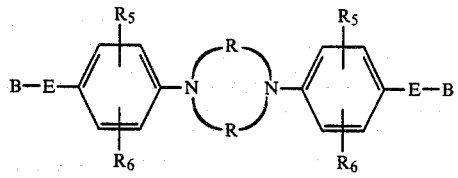

(III)

and compounds represented by formula (IV);

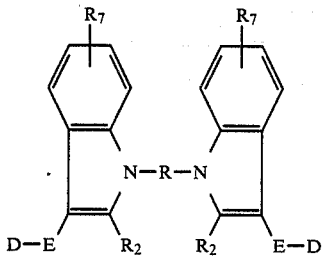

(IV)

wherein R represents a substituted or unsubstituted alkylene or alkenylene group having from 1 to 20 carbon atoms which may contain therein one or more of an oxygen atom or a nitrogen atom; B represents

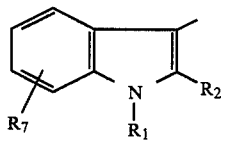

D represents

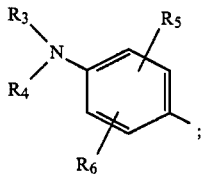

E represents

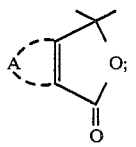

$R_1$, $R_2$, $R_3$, and $R_4$, which may be the same or different, each represents a hydrogen atom, a substituted or unsubstituted alkyl group, a substituted or unsubstituted acyl group or a substituted or unsubstituted aryl group, or $R_3$ and $R_4$ are taken together to form a 5- to 8-membered ring; $R_5$, $R_6$ and $R_7$, which may be the same or different, each represents a hydrogen atom, a substituted or unsubstituted alkyl group, a substituted or unsubstituted aryl group, a halogen atom, a substituted or unsubstituted alkoxy group or a substituted amino group; and A represents atoms necessary for forming a substituted or unsubstituted aromatic ring.

8. A recording material as claimed in claim 7, wherein either one of $R_3$ and $R_4$ represents an alkyl group.

9. A recording material as claimed in claim 7, wherein $R_5$ represents a hydrogen atom, a substituted amino group, or an alkyl group, and $R_6$ represents a substituted amino group or an alkoxy group.

10. A recording material as claimed in claim 7, wherein $R_1$, $R_2$, $R_3$, and $R_4$ each represents a hydrogen atom, an alkyl group having from 1 to 18 carbon atoms, an acyl group, an alkyl group having from 1 to 18 carbon atoms substituted with a halogen atom, an alkoxy group, an aryl group, an aryloxy group, an acyl group, a cyano group or a furfuryl group, an aryl group having from 6 to 12 carbon atoms or an aryl group having from 6 to 12 carbon atoms substituted with a halogen atom, an alkoxy group, an aryl group, an aryloxy group, an alkyl group or an acyl group; and $R_5$, $R_6$, $R_7$ each represents a hydrogen atom, an alkyl group having from 1 to 18 carbon atoms, an alkoxy group having from 1 to 18 carbon atoms, a chlorine atom, a bromine atom, a mono- or di-alkylamino group having from 1 to 12 carbon atoms or a monoacylamino group having from 1 to 16 carbon atoms.

11. A recording material as claimed in claim 7, wherein ring A represents

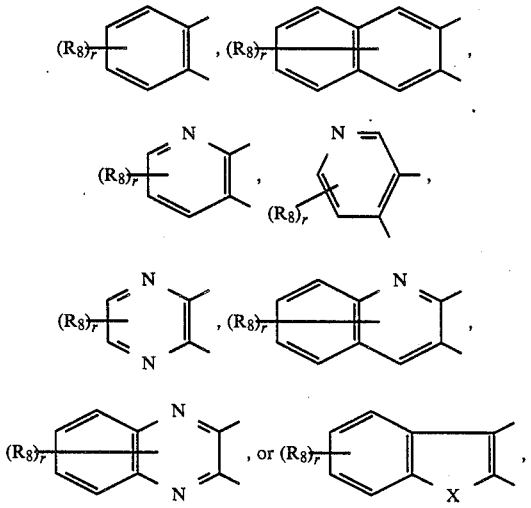

wherein $R_8$ has the same meaning as $R_7$, X represents an oxygen atom, a sulfur atom or —$NR_9$—; r represents an integer of from 1 to 6; and $R_9$ has the same meaning as $R_3$.

12. A recording material as claimed in claim 7, wherein A is

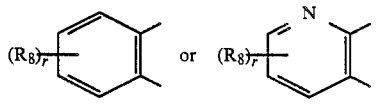

wherein $R_8$ has the same meaning as $R_7$, and r represents an integer of from 1 to 6.

13. A recording material as claimed in claim 12, wherein said colorless dye is selected from the compounds represented by formula (I) or (IV).

14. A recording material as claimed in claim 7, wherein R is —$C_nH_{2n}$—,

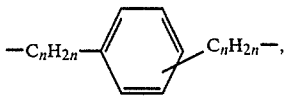

—$C_nH_{2n}SC_nH_{2n}$—, —$C_nH_{2n}OC_nH_{2n}$— or —$C_nH_{2n}OC_nH_{2n}OC_nH_{2n}$—, wherein n represents an integer of from 1 to 20.

15. A recording material as claimed in claim 7, wherein said electron-accepting compound is a phenol derivative or a salicyclic acid derivative.

16. A recording material as claimed in claim 15, wherein said electron-accepting compound is a phenol derivative having 12 or more carbon atoms or a salicyclic acid derivative having 15 or more carbon atoms or a metal salt thereof.

17. A recording material as claimed in claim 7, wherein said recording material is a pressure-sensitive recording material.

18. A recording material as claimed in claim 7, wherein said recording material is a heat-sensitive recording material.

19. A recording material comprising an electron-donating colorless dye and an electron-accepting compound, wherein said colorless dye is selected from compounds represented by formula (I);

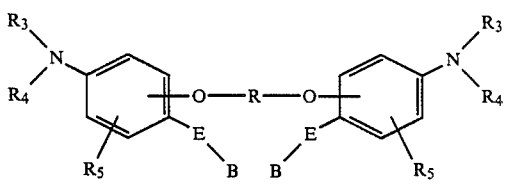

(I)

compounds represented by formula (II);

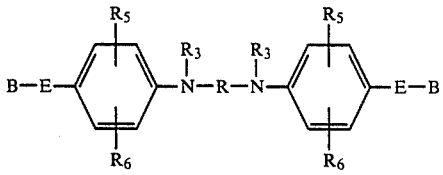

(II)

compounds represented by formula (III);

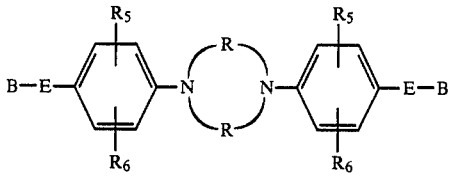

(III)

and compounds represented by formula (IV);

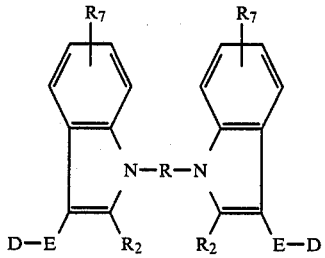

(IV)

wherein R represents a substituted or unsubstituted alkylene or alkenylene group having from 1 to 20 carbon atoms which may contain therein one or more of an oxygen atom or a nitrogen atom; B represents

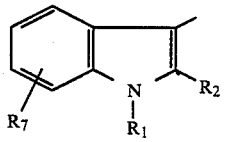

D represents

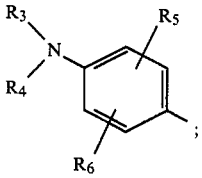

E represents

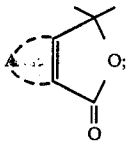

$R_1$, $R_2$, $R_3$, and $R_4$, which may be the same or different, each represents a hydrogen atom, a substituted or unsubstituted alkyl group, a substituted or unsubstituted acyl group or a substituted or unsubstituted aryl group, or $R_3$ and $R_4$ are taken together to form a 5- to 8-membered ring; $R_5$, $R_6$ and $R_7$, which may be the same or different, each represents a hydrogen atom, a substituted or unsubstituted alkyl group, a substituted or unsubstituted aryl group, a halogen atom, a substituted or unsubstituted alkoxy group or a substituted amino group; and A represents atoms necessary for forming a substituted or unsubstituted aromatic ring, and wherein said electron accepting compound is a phenol derivative having 12 or more carbon atoms or a salicylic acid derivative having 15 or more carbon atoms or a metal salt thereof.

* * * * *